US005953842A

United States Patent [19]

Bodell

[11] Patent Number: 5,953,842

[45] Date of Patent: Sep. 21, 1999

[54] TAMPER-RESISTANT ILLUMINATED SIGN

[75] Inventor: Steven W. Bodell, Troutville, Va.

[73] Assignee: Hubbell Incorporated, Orange, Conn.

[21] Appl. No.: 08/904,608

[22] Filed: Aug. 1, 1997

[51] Int. Cl.[6] ..... G09F 13/04

[52] U.S. Cl. ..... 40/570; 40/574

[58] Field of Search ..... 40/570, 574, 580, 40/202; 411/910

[56] References Cited

U.S. PATENT DOCUMENTS

| | | | |
|---|---|---|---|
| 1,699,191 | 1/1929 | Holmes | 40/202 |
| 1,983,105 | 12/1934 | Stewart | 40/125 |
| 2,029,221 | 1/1936 | Burgess et al. | 40/132 |
| 2,763,077 | 9/1956 | Neely | 40/125 |
| 3,187,452 | 6/1965 | Dotson | 40/202 |
| 3,296,431 | 1/1967 | Green | 40/570 |
| 3,324,290 | 6/1967 | Lasker | 240/11.2 |
| 3,402,494 | 9/1968 | Gray | 40/130 |
| 3,780,462 | 12/1973 | Pregel et al. | 40/130 R |
| 4,201,005 | 5/1980 | Hunt | 40/570 |
| 4,383,382 | 5/1983 | Hegarty | 40/545 |
| 4,791,535 | 12/1988 | Sclafani et al. | 411/910 |
| 4,967,317 | 10/1990 | Plumly | 362/31 |
| 5,012,602 | 5/1991 | Storey | 40/202 |
| 5,018,290 | 5/1991 | Kozek et al. | 40/570 |
| 5,299,109 | 3/1994 | Grondal | 362/241 |
| 5,388,357 | 2/1995 | Malita | 40/570 |
| 5,485,145 | 1/1996 | Sniff | 340/815.4 |
| 5,697,175 | 12/1997 | Schwartz | 40/570 |
| 5,729,925 | 3/1998 | Prothero | 40/570 |

FOREIGN PATENT DOCUMENTS

| | | | |
|---|---|---|---|
| 259192 | 12/1963 | Australia | 40/580 |

OTHER PUBLICATIONS

Hubbell Lighting, Inc.; Exit Sign Drawing; sold 1995.

Hubbell Lighting, Inc.; Buyer's Guide; 1994; pp. 136–141.

Hubbell Lighting, Inc.; *Hubbell's Brighter New Die Cast Exits*; Feb. 1995; four pages.

*Primary Examiner*—Brian K. Green
*Assistant Examiner*—Marcus Dolce
*Attorney, Agent, or Firm*—Jerry M. Presson; David L. Tarnoff; Thomas P. Hilliard

[57] ABSTRACT

An illuminated sign having a housing with a back wall and a peripheral wall extending around the back wall to form an illuminating recess. The housing further having a top and a bottom and a bracket located within the recess, adjacent the top. An illuminating device is also positioned within the recess. A cover is hingedly coupled to the bottom of the housing by a hinge for pivotal movement relative to the housing between a closed position and an open position. The cover has an inner side facing the housing and an oppositely facing outer side. A transparent, protective shield is coupled directly to the outer side of the cover. A first tamper-resistant fastener is located adjacent the top of the housing and couples together the bracket and the cover for selectively securing the cover in the closed position. Second tamper-resistant fasteners are located adjacent the top of the housing and rigidly couple the protective shield and the cover together for allowing the cover and the shield to be pivoted together between the open and closed positions. The first tamper-resistant fastener is located between two second tamper-resistant fasteners.

28 Claims, 4 Drawing Sheets

TAMPER-RESISTANT ILLUMINATED SIGN

BACKGROUND OF THE INVENTION

In environments such as schools, illuminated signs are often vandalized. Vandalism occurring to emergency signs such as exit signs presents a hazard in the event of an actual emergency. Accordingly, tamper-resistant illuminated exit signs have been developed.

Typically, tamper-resistant illuminated exit signs use a plastic shield that is wrapped around both the front face and the bottom of the sign housing. The shield is often held on by tamper-resistant screws that are usually located in the four corners of the front face as well as in two locations in the bottom. Thus, in order to access the electronics within the exit sign, all six tamper-resistant screws must be removed. This is time consuming and burdensome to those who legitimately need to access the interior of the sign.

Another tamper-resistant illuminated exit sign has been developed which attempts to solve the problems mentioned above with respect to the typical tamper-resistant illuminated exit signs. This modified tamper-resistant illuminating exit sign attempts to facilitate entry by attaching a plastic shield only to the face of the exit sign through the use of four tamper-resistant screws. Three short screws extend only into the face of the exit sign and one long screw extends completely into and is secured to the housing. Each of the screws are located in a corner of the sign. Thus, it is necessary to remove only one tamper-resistant screw for accessing the interior of the exit sign.

However, this modified tamper-resistant exit sign has numerous disadvantages. For instance, the long screw is difficult to engage with the housing since it must be secured to the back of the housing. Additionally, since the long screw is positioned in a corner, the degree of tamper resistance across the exit sign is not uniform. Further, the modified tamper-resistant exit sign is not readily convertible to a double-faced exit sign, i.e., an exit sign with the word "EXIT" on two, oppositely facing sides.

Examples of prior art illuminated signs are disclosed in the following U.S. Pat. No. 2,029,221 to Burgess et al.; U.S. Pat. No. 3,324,290 to Lasker; U.S. Pat. No. 3,402,494 to Gray; U.S. Pat. No. 3,780,462 to Pregel et al.; U.S. Pat. No. 4,201,005 to Hunt; U.S. Pat. No. 4,967,317 to Plumly; U.S. Pat. No. 5,018,290 to Kozek et al.; U.S. Pat. No. 5,299,109 to Grondal; and U.S. Pat. No. 5,485,145 to Sniff. Examples of prior art tamper-resistant signs are disclosed in the following U.S. Pat. No. 1,983,105 to Stewart; U.S. Pat. No. 2,763,007 to Neely; and U.S. Pat. No. 4,383,382 to Hegarty.

Thus, there is a continuing need to provide improved tamper-resistant illuminated signs, especially tamper-resistant illuminated exit signs. This invention addresses this need in the art along with other needs which will become apparent to those skilled in the art from this disclosure.

SUMMARY OF THE INVENTION

One object of the invention to provide an illuminated sign that resists unauthorized entry.

Another object of the invention is to provide a tamper-resistant illuminated sign that provides easy access to the interior of the sign for maintenance and the like.

Another object of the invention is to provide an illuminated exit sign that resists unauthorized modification to the internal electronics and keeps foreign objects out of the interior of the housing.

Yet another object of the invention is to provide a tamper-resistant illuminated exit sign that provides easy access to the interior of the sign by removing a single fastener.

A further object of the invention is to provide a tamper-resistant exit sign that is easily converted to a double-faced exit sign.

The foregoing objects are basically obtained by providing an illuminated sign, comprising a housing having a first wall and a peripheral wall extending around the first wall to form an illuminating recess, the housing further having a first end, a second end opposite to the first end, and a first securing member located adjacent the first end; an illuminating device coupled to the housing within the recess; a first panel hingedly coupled to the second end of the housing by a hinge for pivotal movement relative to the housing between a closed position and an open position, the first panel having an inner side facing the housing and an oppositely facing outer side; a second panel coupled directly to the outer side of the first panel; a first fastener located adjacent the first end of the housing and coupled to the first securing member and to the first panel for selectively securing the first panel in the closed position; and two second fasteners located adjacent the first end of the housing rigidly coupling the first panel and the second panel together for allowing the first and second panels to be pivoted together between the open and closed positions, and the first fastener being located between the two second fasteners.

The foregoing objects are also attained by providing an illuminated sign, comprising a housing having a first wall and a peripheral wall extending around the first wall to form an illuminating recess, the housing further having a bracket with an attaching element, the bracket being positioned within the recess and being coupled to the housing by at least one bracket fastener; an illuminating device coupled to the housing within the recess; a first panel hingedly coupled to the housing by a hinge for pivotal movement relative to the housing between a closed position and an open position, the first panel having an inner side facing the housing and an oppositely facing outer side; a second panel coupled directly to the outer side of the first panel; a first fastener coupled directly to the attaching element and to the first panel for selectively securing the first panel in the closed position; and at least one second fastener rigidly coupling the first panel and the second panel together for allowing the first and second panels to be pivoted together between the closed and open positions.

The foregoing objects are further attained by providing an illuminated sign, comprising a housing having a first wall and a peripheral wall extending around the first wall to form an illuminating recess, the housing further having a top, a bottom, and a bracket located adjacent the top with a threaded central opening; an illuminating device coupled to the housing within the recess; a first panel hingedly coupled to the bottom of the housing by a hinge for pivotal movement relative to the housing between a closed position and an open position, the first panel having an inner side facing the housing, an oppositely facing outer side, two top apertures, two bottom apertures, and a central aperture extending completely through the first panel, the central aperture being aligned with the central opening and between the two top apertures; a transparent second panel coupled directly to the outer side of the first panel and having two top holes aligned with the two top apertures, and two bottom holes aligned with the two bottom apertures; a threaded central fastener extending through the central aperture and into the threaded central opening for selectively securing the first panel to the housing in the closed position, the central fastener having a first head and an opposite first threaded portion; and four threaded perimeter fasteners for rigidly securing the second panel to the first panel, each of the perimeter fasteners extending through one of the two top holes and the two bottom holes and one of the two top apertures and the two bottom apertures, each of the perimeter fasteners having a second head and an opposite second threaded portion, the second head being different than the first head.

Other objects, advantages, and salient features of the invention will become apparent from the following detailed description, which, taken in conjunction with the annexed drawings, discloses preferred embodiments of the invention.

BRIEF DESCRIPTION OF THE DRAWINGS

Referring now to the attached drawings which form a part of this original disclosure.

DETAILED DESCRIPTION OF THE INVENTION

Figure 1:
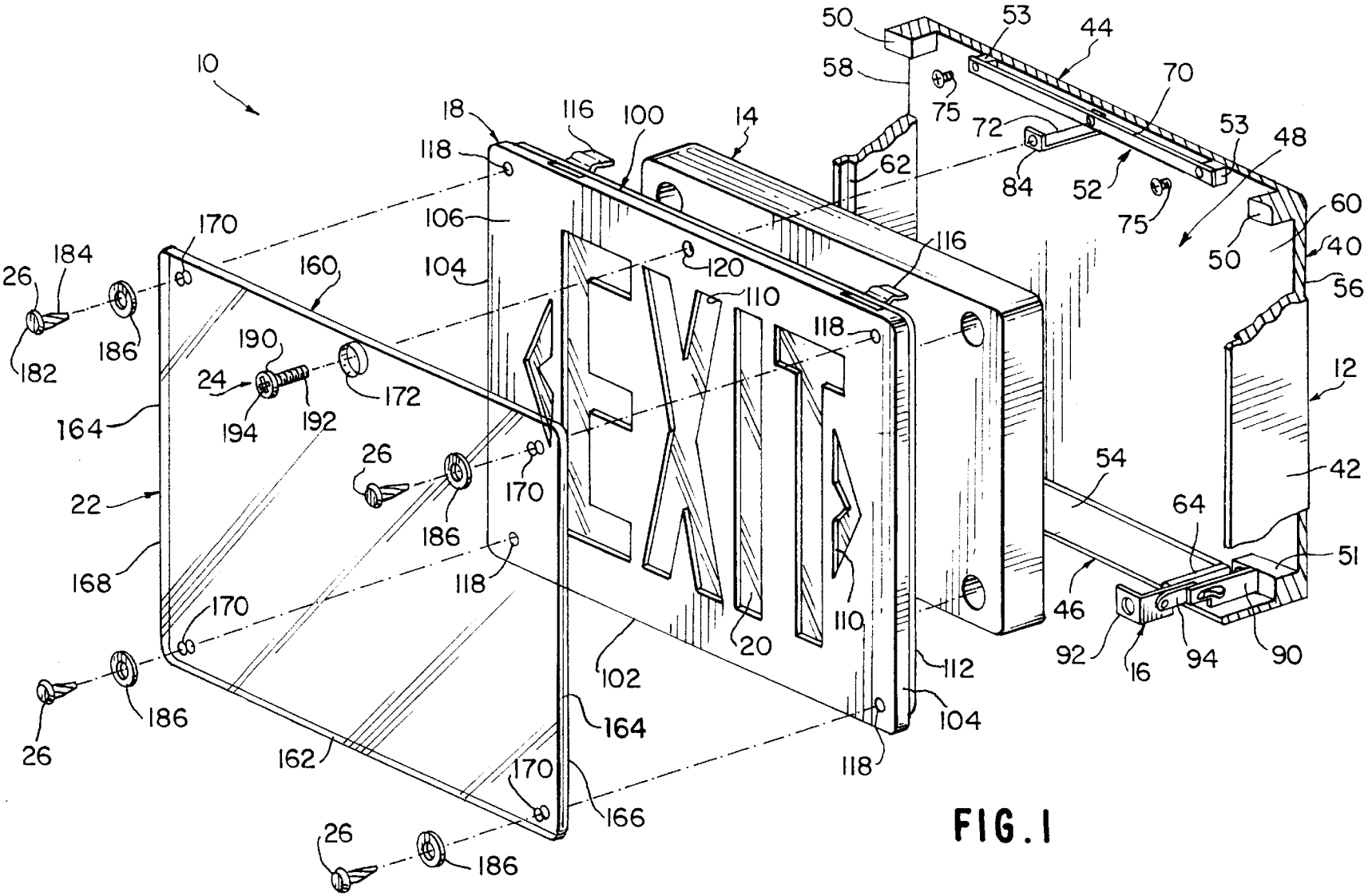
FIG. 1 is an exploded, front side perspective view of the illuminated sign in accordance with the present invention with the housing illustrated in partial cross section.
Figure 2:
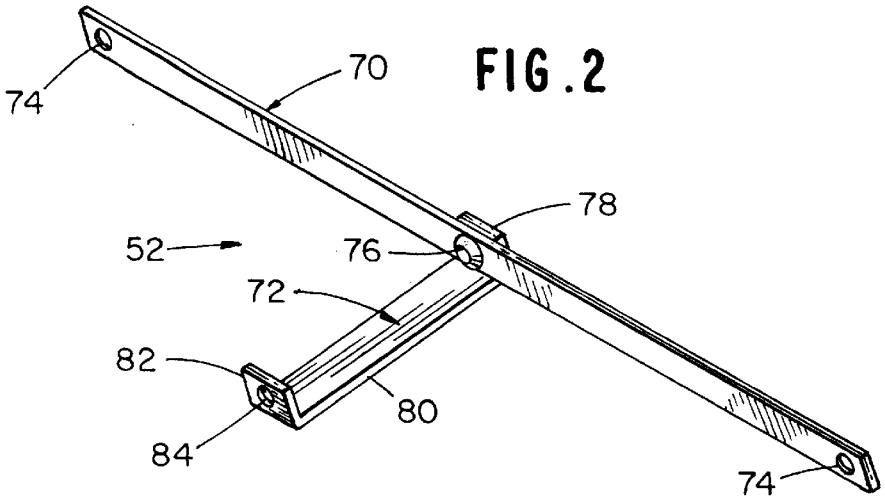
FIG. 2 is a front side perspective view of a first embodiment of the bracket of the illuminated sign in accordance with the present invention.
Figure 3:
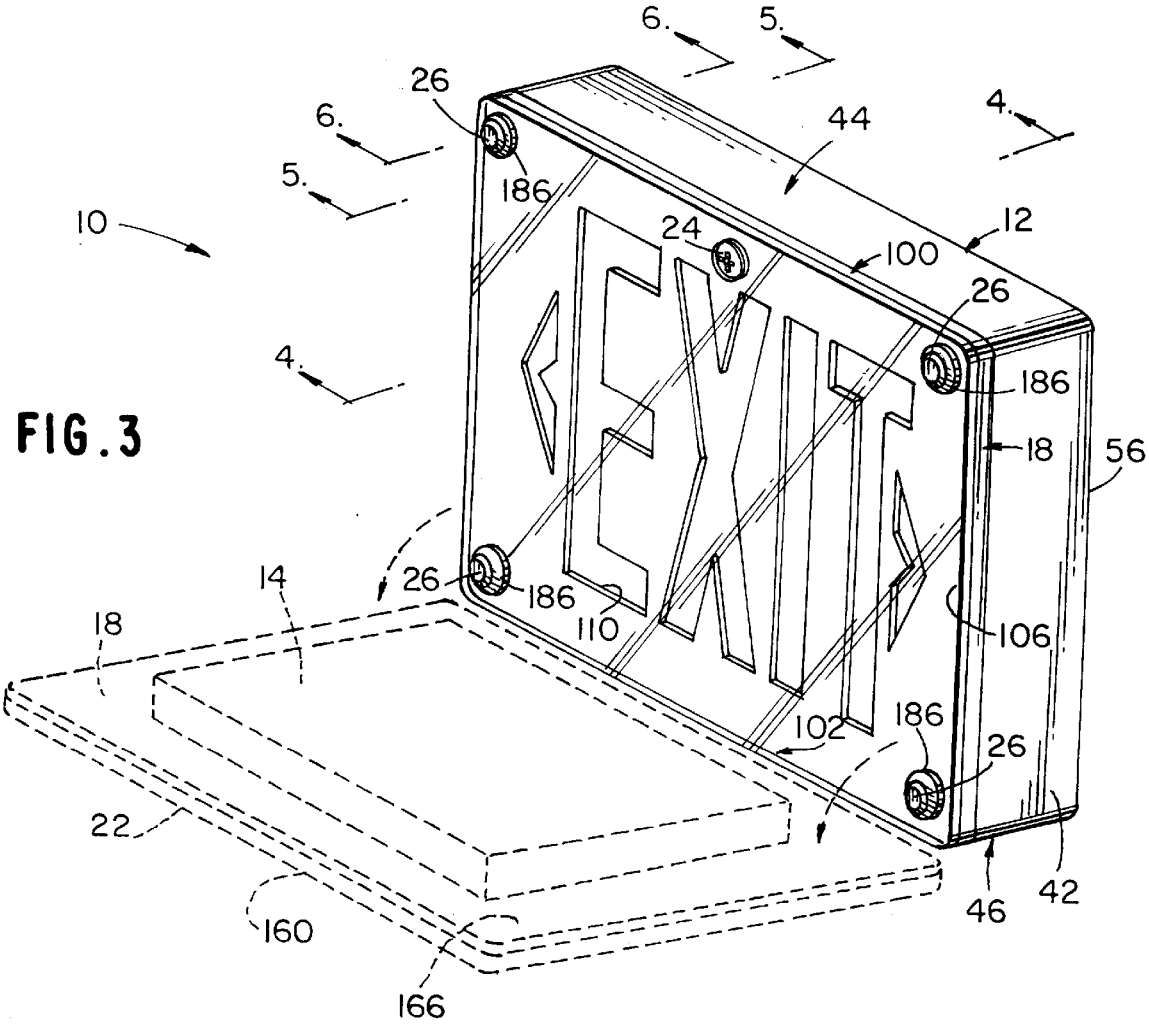
FIG. 3 is a front side perspective view of the illuminated sign in accordance with the present invention with the cover in the closed position and with dashed lines illustrating the cover in the open position.
Figure 4:
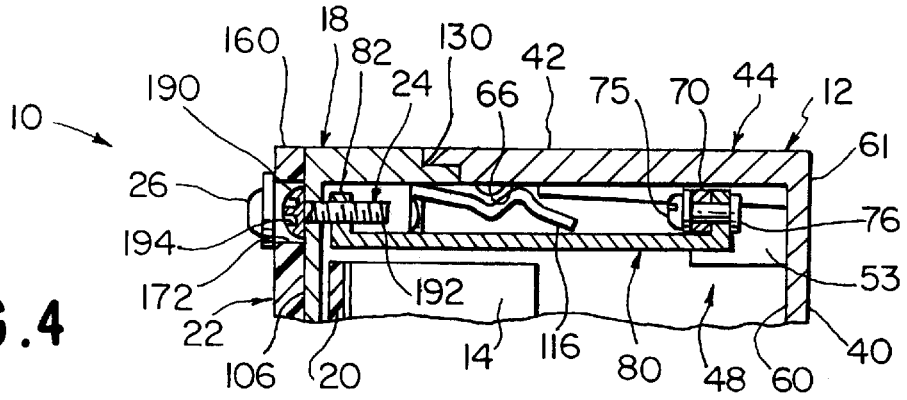
FIG. 4 is a partial, cross-sectional view of the illuminated sign in accordance with the present invention taken along line 4—4 in FIG. 3 and illustrating the connection between the bracket and the tamper-resistant screw.

As seen in FIGS. 1–6, the illuminated sign 10 in accordance with the present invention comprises a housing 12, an illuminating device 14, a pair of hinges 16, a cover 18, a colored panel 20, a shield 22, a tamper-resistant screw 24, and drive screws 26. Shield 22 is fixedly attached to cover 18 by four drive screws 26, while cover 18 is releasably attached to housing 12 by a single tamper-resistant screw 24 and hinges 16 for accessing the interior of sign 10. When tamper-resistant screw 24 is secured to housing 12 as discussed below and as illustrated in FIG. 3, cover 18 substantially closes the front opening of housing 12 and is in its closed position. When tamper-resistant screw 24 is disengaged and removed from housing 12, cover 18 is capable of being pivoted away from housing 12 about hinges 16 to an open position that is approximately 90 degrees from the closed position as illustrated in dashed lines in FIG. 3.

Housing 12 comprises a first wall or back wall 40, a peripheral wall 42, a first end or top 44, a second end or bottom 46, an illuminating recess 48, top lugs 50, bottom lugs 51, a bracket 52, supports 53, a steel plate 54, and sides 56 and 58. Preferably, back wall 40, peripheral wall 42, top lugs 50, bottom lugs 51, and supports 53 are all integrally formed of one-piece construction from die-cast aluminum. Alternatively, housing 12 can be formed as separate elements and formed from materials other than aluminum that will provide sufficient rigidity and security. The basic structure of housing 12 is a substantially conventional illuminated sign housing that is known in the art, except for bracket 52 and the manner in which top lugs 50, bottom lugs 51 and supports 53 are employed. Accordingly, housing 12 will not be described in great detail herein.

Back wall 40 is substantially rectangular and has a substantially flat inner face 60 and a substantially flat outer face 61. Peripheral wall 42 extends substantially perpendicularly from the perimeter of back wall 40 completely along top 44 and sides 56 and 58 and partially along portions of bottom 46 adjacent sides 56 and 58. Along its entire extension, peripheral wall 42 has a groove 62 for receiving cover 18 as discussed below.

Lugs 50 and 51, and supports 53 are all located at the junction of and integrally formed with back wall 40 and peripheral wall 42. Each of the two top lugs 50 are located in one of the two upper corners of back wall 40, while each of the two bottom lugs 51 are located in one of the two lower corners of back wall 40. Lugs 50 and 51 and supports 53 are all solid figures that are generally hexahedral in shape with a flat surface that is substantially parallel to inner face 60. Lugs 50 and 51 are large enough to have a threaded hole formed therein to receive a single fastener when sign 10 is used as a double-faced sign as discussed below. Additionally, although bottom lugs 51 are similar to top lugs 50, bottom lugs 51 are larger since each has one threaded hole for receiving a screw for attaching one of the hinges 16 thereto as is known in the art. Supports 53 have a threaded opening therein for receiving a threaded fastener as discussed below. Each pair of top lugs 50, bottom lugs 51, and supports 53 are substantially identical pairs except for each member of the pair being a mirror image of the other member of the pair.

Peripheral wall 42 extends continuously around the perimeter of back wall 40 except for the location of steel plate 54 adjacent bottom 46. Together, peripheral wall 42 and steel plate 54 completely surround the perimeter of back wall 40. Back wall 40, peripheral wall 42, and steel plate 54 combine to form illuminating recess 48. Peripheral wall 42 also has two indents 66 located adjacent top 44 for securing cover 18 to housing 12 as discussed below.

On either side of steel plate 54, peripheral wall 42 has slots (not shown) that are substantially parallel to peripheral wall 42 for receiving steel plate 54 therein. The slots are formed in raised members 64 as is known in the art. Therefore, when cover 18 is in the open position, steel plate 54 can be removed from peripheral wall 42 in a sliding manner. However, when cover 18 is closed, steel plate is held within the slots and is prohibited from moving from its position.

As is known in the art, steel plate 54 can support a push button test switch for testing the battery of the illuminated sign 10 if such is employed. Also, as is known in the art, steel plate 54 can support an LED to indicate when AC power is on, if such is employed.

Bracket 52 is formed of a cross bar 70 and an extension 72. Both cross bar 70 and extension 72 are preferably formed of flat, narrow strips of metallic material, such as steel. Cross bar 70 has an aperture 74 at each end aligned with the threaded opening in each support 53. Apertures 74 receive bracket screws 75 which are threadedly engaged within supports 60 to rigidly secure bracket 52 to back wall 40.

Extension 72 is rigidly connected to cross bar 70 at the middle of cross bar 70 by a rivet 76. Alternatively, extension and cross bar 70 can be coupled by any conventional manner, such as welding. Extension 72 has a riveted end 78 that is substantially flush and parallel with cross bar 70 and an L-shaped portion 80 that extends from riveted end 78 away from cross bar 70 towards cover 18. L-shaped portion 80 initially extends substantially perpendicularly from cross bar 70 to a connecting end 82 which is substantially parallel to cross bar 70 and to inner face 60 of back wall 40. Connecting end 82 has an attaching element or threaded hole 84 extending completely therethrough for receiving tamper-resistant screw 24. Also, L-shaped portion 80 and its connecting end 82 are sufficiently long so that when sign 10 is in the closed position, connecting end 82 and threaded hole 84 will be adjacent cover 18. This will require that the tamper-resistant screw 24 only travels a short distance before being secured by connecting end 82 to ensure easy installation of tamper-resistant screw 24. It should be understood that FIG. 2 illustrates one embodiment of bracket 52. Alternative bracket designs are possible as discussed below.

Two spaced hinges 16 enable cover 18 to pivot between the closed and open positions and to remain freestanding in the open position. That is, hinge 16 is capable of maintaining cover 18 in a position where it is substantially perpendicular to back wall 40. Hinges 16 are substantially identical except that one is the mirror image of the other. Hinges 16 are known in the art and, therefore, will be described only briefly herein.

Each hinge 16 is attached to housing 12 by a bottom lug 51 and a screw received therein and is attached to cover 18 by another screw as discussed below. Each hinge 18 is a three-element metallic linkage comprising a housing element 90, a cover element 92, and a middle element 94. Each housing element 90 is rigidly connected to a bottom lug 51 and contains a arcuate slot therethrough. Middle element 94 has a projection capable of pivoting and sliding within the slot of housing element 90. Also, middle element 94 is free to pivot around cover element 92. Cover element 92 is rigidly connected to cover 18 by a screw extending into a lug in cover 18.

Cover 18 has a top 100, a bottom 102, two sides 104, an outer face 106, an inner face 108, cut outs 110, a peripheral flange 112, top lugs 114, bottom lugs (not shown), supports 115, clips 116, four corner holes 118, and a central hole 120. Except for clips 116, cover 18 is formed as an integral, one-piece element formed preferably of metallic material such as aluminum and preferably is die-cast. Cover 18 is known in the art except for central hole 120 and, therefore, cover 18 will not be described in great detail herein.

Cover 18 is substantially rectangular and is substantially the same shape as back wall 40 of housing 12. Outer and inner faces 106 and 108 are substantially flat and parallel to each other. Peripheral flange 112 extends around the entire perimeter of inner face 108 and is substantially perpendicular to inner face 108.

Peripheral flange 112 has a continuous groove 130 and releasing indents 132. Groove 130 extends continuously and completely around the entire extent of peripheral flange 112 and is sized to receive the outward edge of peripheral wall 42 of housing 12 as illustrated in FIGS. 4–7. Likewise, the outward edge of peripheral wall 42 is received by groove 130 of peripheral flange 112. The interlocking between peripheral flange 112 of cover 18 and peripheral wall 42 of housing 12 ensures a snug and secure fit between cover 18 and housing 12.

Top lugs 114 and bottom lugs of cover 18 are substantially identical to top lugs 50 and bottom lugs 51 of housing 12, respectively. The only difference being the presence of a corner hole 118 in each of the top lugs 114 and the bottom lugs of cover 18. Each top lug 114 and bottom lug of cover 18 is located in one of the corners of cover 18 at the junction of inner face 108 and peripheral flange 112 and is integrally formed of one-piece construction with inner face 108 and peripheral flange 112. Each corner hole 118 is threaded and extends completely through cover 18 between outer face 106 and inner face 108. Each opening 136 is sized to receive one of the drive screws 26 as discussed below. Each of the two bottom lugs of cover 18 are elongated in the same manner as bottom lugs 51 of housing 12 to also receive part of one of the hinges 16. Each bottom lug of cover 18 is rigidly attached to a cover element 92 of each hinge 16 by receiving a screw that extends through one of the cover elements 92. Each pair of top lugs 114 and bottom lugs of cover 18 are substantially identical pairs except for each member of the pair being a mirror image of the other member of the pair.

Supports 115 are similar to supports 53 of housing 12 but each is adapted to receive a clip 116. Supports 115 are spaced, solid projections formed at the junction of the peripheral flange 112 and the inner face 108 of cover 18. Supports 115 are integrally formed of one-piece construction with the peripheral flange 112 and the inner face 108 and are formed of surfaces that are substantially parallel or substantially perpendicular to inner face 108. Each support 115 has a threaded hole extending partially therethrough towards outer surface 106 from a lug surface that is substantially parallel to inner surface 108 for receiving a clip fastening screw 122. Each of the pair of supports 115 is substantially identical except for one member of the pair being the mirror image of the other member of the pair.

Figure 5:
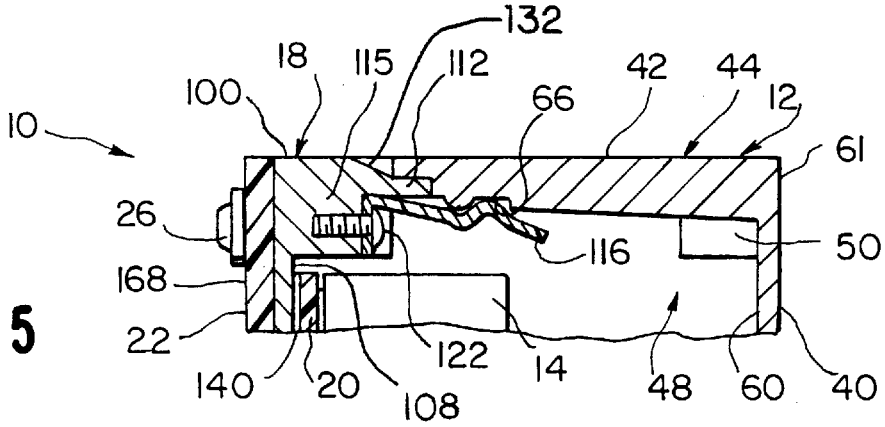
FIG. 5 is a partial, cross-sectional view of the illuminated sign in accordance with the present invention taken along line 5—5 of FIG. 3 and illustrating the connection between the clips and the housing.

Each of two clips 116 are attached to one of the supports 115 by one clip fastening screw 122 that is threaded into its respective support 115. Thus, clips 116 are separated and positioned adjacent top 100 of cover 18 each near one of the sides 104. As best illustrated in FIG. 5, a clip 116 extends from support 115 to be received in a indent 66 in housing 12. Since both clips 116 and indents 66 are identical, only one of each is illustrated and described in detail.

When sign 10 is in the closed position, as illustrated in FIG. 5, clip 116 is received in indent 66 in housing 12 to aid in keeping housing 12 and cover 18 securely in the closed position. As is known in the art, a spring force maintains clip 116 within indent 66. However, when it is desired to pivot cover 18 away from housing 12, the spring force or resistance of clip 116 can be manually overcome and cover 18 can be released from housing 12 if tamper-resistant screw 24 has already been removed. Thus, indents 66 provide a gripping area for a portion of clip 116 to maintain cover 18 in the closed position when tamper-resistant screw 24 is not yet employed.

Cutouts 110 extend completely through cover 18 between outer face 106 and inner face 108. As illustrated in FIGS. 1 and 3, if sign 10 is formed as an exit sign, cut outs 110 are formed to spell the word "EXIT" and can form chevrons that can be located on either or both sides of the word to indicate the direction of the nearest exit. The chevrons are optionally used depending upon the direction of the desired exit.

Corner holes 118 extend completely through cover 18 between outer face 106 and inner face 108 and completely through a respective top lug 114 or bottom lug of cover 18. Thus, each hole 118 is located in a corner of cover 18. Corner holes 118 are preferably threaded.

Central hole 120 extends completely through cover 18 between outer face 106 and inner face 108. Central hole 120 is located adjacent top 100 at a point that is approximately the middle point of cover 18 between sides 104 and between the two top holes 118. Additionally, central hole 120 is aligned to be coaxial with threaded hole 84 of bracket 52.

Colored panel 20 is a substantially flat, thin panel of translucent plastic that permits light to pass therethrough. Colored panel 20 is known in the art and, therefore, will only be briefly described herein. If sign 10 is an exit sign, colored panel 20 is preferably colored red or green to accentuate the visual impact of cut outs 110 in cover 18 for easier recognition. Colored panel 20 is substantially rectangular and fits flush against inner face 108 of cover 18 within the area which peripheral flange 112 surrounds. Colored panel 20 is adhesively attached to inner face 108 through the use of double sided adhesive 140 or other convention fastener.

Illuminating device 14 is also known in the art and, therefore, will be described only briefly herein. As illustrated in FIG. 1, illuminating device 14 is preferably a diffused LED device in which rows of LED's are arranged within a LED housing that is attached to the inner face 108 of cover 18. LED illuminating devices are known in the art as illustrated in U.S. Pat. No. 4,967,317 to Plumly and U.S. Pat. No. 5,018,290 to Kozek et al. Accordingly, Applicant hereby incorporates U.S. Pat. No. 4,967,317 to Plumly and U.S. Pat. No. 5,018,290 to Kozek et al. herein by reference. Alternatively, illuminating device 14 can be any conventional illuminating device used for illuminated signs. For example, illuminating device 14 can be a florescent illuminating device or an incandescent illuminating device. Regardless of the specific illuminating device 14 employed, illuminating device 14 can be powered as conventional device illuminating signs. Thus, illuminating device 14 can be powered by AC and/or by a battery.

Shield 22 has a top 160, a bottom 162, two sides 164, an inner face 166, an outer face 168, four corner holes 170 and one central hole 172. Shield 22 is made of a transparent plastic material. Preferably, shield 22 is made of a colorless, polycarbonate material that is sufficiently strong to protect against unauthorized entry into housing 12 therethrough. Although various polycarbonates can be used, a preferred polycarbonate material for shield 22 is sold under the trademark LEXAN. Shield 22 is preferably 0.60 inch thick.

Shield 22 is generally rectangular in a substantially identical shape as cover 18 and back wall 40. Inner and outer faces 166 and 168 are substantially parallel and shield 22 has four corner holes 170 extending completely through shield 22 between inner face 166 and outer face 168. Each hole 170 is aligned to be coaxial with and is the same size as a respective hole 118 in cover 18.

Shield 22 also has a central hole 172 located adjacent top 160 and extending completely through shield 22 between inner face 166 and outer face 168. Central hole 172 is aligned to be coaxial with central hole 120 of cover 18 and threaded hole 84 of bracket 52. However, central hole 172 is preferably larger than central hole 120 of cover 18 so that tamper-resistant screw 54 can be completely received within central hole 172 and directly abut and contact outer face 106 of cover 18. This enables a more secure connection between tamper-resistant screw 24 and bracket 52.

Figure 6:
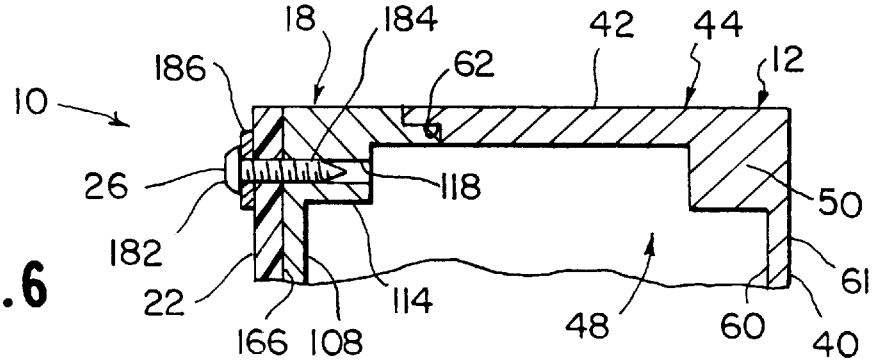
FIG. 6 is a partial, cross-sectional view of the illuminated sign in accordance with the present invention taken along line 6—6 of FIG. 3 and illustrating the connection between the shield, the cover and a drive screw.

Shield 22 is rigidly attached to cover 18 by four drive screws 26. Each drive screw 22 has a head 182 and a threaded portion 184 that extends through one of the corner holes 118. Preferably each drive screw 26 has a washer 186 into which it is inserted. Washers 186 provide for a greater contact area between each head 182 and outer face 168 of shield 22. Each threaded portion 184 is sufficiently long to extend completely through its respective hole 170 in shield 22 and to extend into its respective hole 118 and into cover 18 as illustrated in FIG. 6. Each drive screw 26 frictionally engages its respective hole 118 in cover 18 to prevent the removing of drive screws 26 without an exceptional amount of force. Preferably, each drive screw 26 does not extend completely through its respective hole 118.

Drive screws 26 substantially resist unauthorized removal thereof and, thus, are substantially tamper-resistant. However, drive screws 26 are not easily removed through the use of a special tool as is the case with tamper-resistant screw 24. Drive screws 26 are preferably steel and implemented together with washers 186 as illustrated in FIGS. 1 and 3 so that shield 22 is securely fastened to cover 18 at the four corners of cover 18 making removal of shield 22 extremely difficult. When shield 22 is fully fastened to cover 18 as illustrated in FIGS. 3–7, inner face 166 of shield 22 is substantially flush with outer face 106 of cover 18. Although drive screws 26 have been disclosed, it should be understood that other fastening devices may be employed to adequately secure shield 22 to cover 18. For instance, screws similar to tamper-resistant screw 24, but shorter, or bolts may also be used in place of drive screws 26.

Tamper-resistant screw 24 has a head 190 and a threaded portion 192 and is preferably made of steel. Head 190 has a recess 194 for receiving a tool such as a screwdriver for securing screw 24 to housing 12 or removing screw 24 from housing 12. However, recess 194 in head 190 is preferably not a common recess. That is, a recess which would receive a conventional screwdriver, for example, a conventional flat head or a conventional cross-shaped head, i.e., PHILLIPS screwdriver. Preferably, recess 194 has a generally cross-shaped recess with a cylindrical extension protruding into recess 194 from the base of recess 194 to the top of head 190. Since recess 194 cannot receive a conventional flat head or cross-shaped head screwdriver, screw 24 is tamper-resistant. The preferred tamper-resistant screw is intended to be removed only by a specific screwdriver having a cross-shaped head and a bore extending therein for receiving the cylindrical extension. One type of acceptable tamper-resistant screw 24 is sold under the trademark TORX. It should be understood, that any non-conventional recess 194 can be employed in head 190. For example, recess 194 can be a socked-shaped recess which receives a mating socket.

When it is desired to secure cover 18 in the closed position against housing 12, tamper-resistant screw 24 is inserted into central hole 172 of shield 22, into central hole 120 of cover 18, and threaded into hole 84 of bracket 52. Central hole 172 is sufficiently large to enable head 190 to pass therein so that head 190 can abut directly against outer face 106 of cover 18. Tamper-resistant screw 24 is then tightened to a sufficient torque that prohibits one from removing tamper-resistant screw 24 by hand or without the use of the screwdriver or tool specifically designed for recess 194 absent destroying parts of sign 10. In other words, tamper-resistant screw 24 is tightened sufficiently to discourage those attempting to access illuminating recess 48 without the screwdriver or tool that mates with tamper-resistant screw 24. However, with the appropriate tool, tamper-resistant screw 24 is easily removed from the bracket 52 and sign 10, enabling cover 18 to be pivoted about hinges 16 from the closed position to the open position. Since drive screws 26 do not engage housing 12, shield 22 remains rigidly connected to cover 18 regardless of whether cover 18 is in the open or the closed position.

Double-Faced Sign

Figure 7:
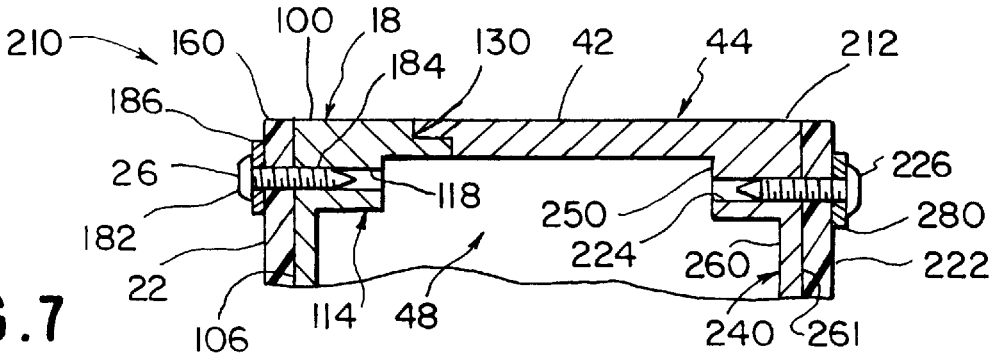
FIG. 7 is a partial, cross-sectional view of a double-faced illuminated sign in accordance with a second embodiment of the present invention, the view being substantially identical to that of FIG. 6, but illustrating the connection of a second shield to the back wall of the housing for a double-faced sign.

As seen in FIG. 7, a double-faced, illuminated sign 210 in accordance with an alternate embodiment of the present invention is illustrated. Double-faced illuminated sign 210 can easily be formed from single faced sign 10. Sign 210 is substantially identical to sign 10, except for the modification of back wall 40 and the addition of a second protective shield 222 as discussed below. Thus, only those aspects that are different than sign 10 will be discussed in detail.

Sign 210 is different from sign 10 in that back wall 240 has additional cut outs similar to cut outs 110. The additional cut outs extend completely through back wall 240 between an inner face 260 and an outer face 261 of back wall 240. For example, if sign 210 is an exit sign, the cut outs in back wall 240 would be arranged so that the word "EXIT" could be read from the direction pointing away from outer face 261 to enable individuals approaching sign 210 from the side facing back wall 240 to identify the exit. Additional cut outs in the form of chevrons can also be employed on back wall 240 to indicate the direction of the exit consistent with the chevrons on cover 18.

When double-faced sign 210 is desired, back wall 240 becomes substantially identical to cover 18 with respect to the illumination of and protection of the cut outs in back wall 240. That is, a colored panel substantially identical to colored panel 20 is attached to back wall 40 in a substantially identical manner as described above with respect to cover 18. Illuminating device 14 would remain unchanged since it provides adequate illumination for the cut outs in back wall 240 as well as the cut outs 110 in cover 18.

To prevent unauthorized entry into sign 210 through back wall 240, second shield 222 is attached to the outer face 261 of back wall 240 in a substantially identical manner as shield 22 is attached to cover 18. Second shield 222 is substantially identical to shield 22 in every manner. Top lugs 250 and bottom lugs adjacent back wall 240 require threaded openings 224 to allow drive screws 226 to be received therein in a substantially identical manner as drive screws 26 are received by shield 22 and cover 18. Drive screws 226 and washers 280 are substantially identical to drive screws 26 and washers 186, respectively.

When fully assembled, double-faced sign 210 has shield 222 securely fastened to back wall 240 at the four corners of back wall 240. Since back wall 240 is rigidly attached to housing 212 and does not separate from housing 212, a tamper-resistant screw similar to screw 24 is not necessary. Thus, back wall 240 does not have a central hole such as that in cover 18, and shield 222 does not have a central hole such as that in shield 22.

Double-faced sign 210 functions in the same way as sign 10 with respect to access by cover 18 to illuminating recess 48. That is, when it is desired to access illuminated recess 48 of double-faced sign 210 for maintenance or other reasons, tamper-resistant screw 24 is unscrewed from bracket 52 and cover 18 and shield 22 are together pivoted down about hinges 16 from the open position to the closed position. After access to illuminating recess 48 is no longer necessary, cover 18 and shield 22 are pivoted back to the closed position about hinges 16 and tamper-resistant screw 24 is secured once again to bracket 52 through threaded hole 84.

Alternative Bracket Design

Figure 8:
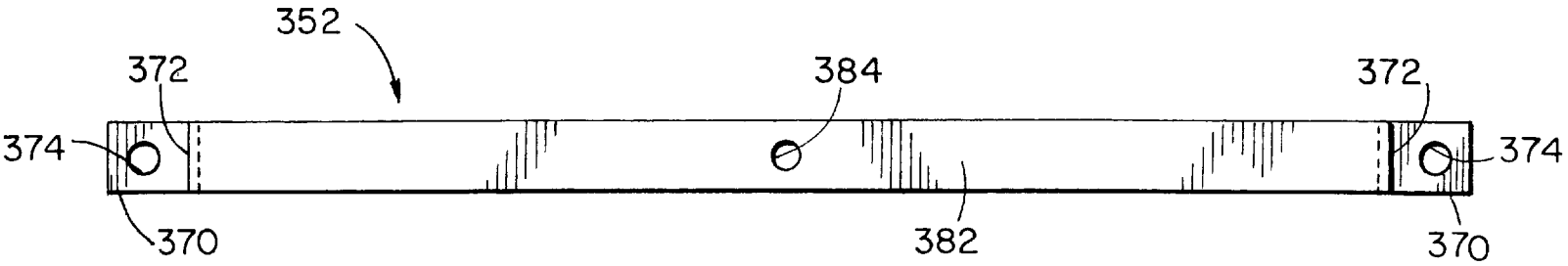
FIG. 8 is a front elevational view of a second embodiment of the bracket of the illuminated sign in accordance with the present invention.
Figure 9:
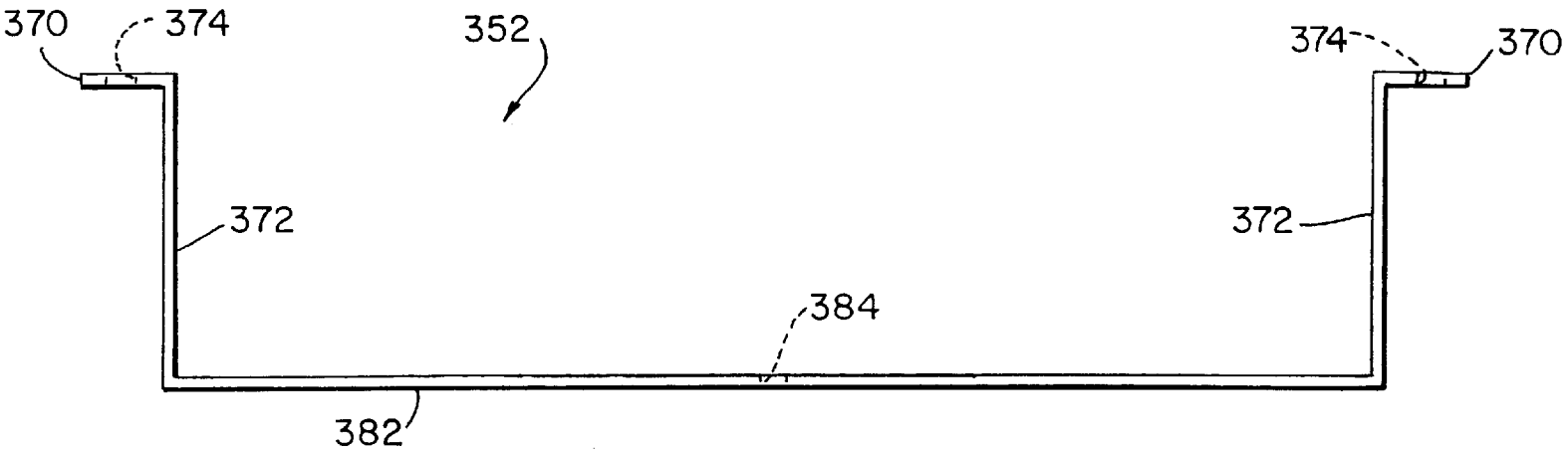
FIG. 9 is a top elevational view of the second embodiment of the bracket that is illustrated in FIG. 8.

Referring now to FIGS. 8 and 9, a bracket 352 that is an alternative to bracket 52. Bracket 352 is generally U-shaped and comprises flanges 370, extensions 372, and a connecting end 382. Bracket 352 is formed from material that is similar to bracket 52. For instance, bracket 352 can be made from pre-galvanized steel. Although, bracket 352 can have various thicknesses, it preferably has a thickness of approximately 0.058 inch. Bracket 352 differs from bracket 52 only in its construction and shape. Thus, bracket 352 functions in substantially an identical manner as bracket 52 discussed above.

Flanges 370 are substantially flat so that each flange 370 abuts a support 53. Additionally, each flange 370 has an aperture 374 extending therethrough that is substantially identical to aperture 74. Apertures 374, receive bracket screw 75 in a manner that is substantially identical to apertures 74 for rigidly securing bracket 352 to supports 53 and housing 12.

Connecting end 382 extends between and is substantially perpendicular to the two extensions 372. Also, connecting end 382 is substantially parallel to flanges 370. At approximately the mid point of connecting end 382, between extensions 372, connecting end 382 has a threaded hole 384 extending therethrough that is substantially identical to threaded hole 84. The construction of bracket 352 is such that threaded hole 384 is positioned in substantially the identical location relative to cover 18 as threaded hole 84 of bracket 52. Thus, although the structure of bracket 352 differs from that of bracket 52, sign 10 functions in a substantially identical manner regardless of whether bracket 52 or bracket 352 is employed. Further, threaded hole 384 receives tamper-resistant screw 24 in a manner that is substantially identical to threaded hole 84.

It should be understood by those skilled in the art that signs 10 and 210 can be mounted in any conventional manner. For example, signs 10 and 210 can be end mounted, ceiling mounted, or surface mounted.

While advantageous embodiments have been chosen to illustrate the invention, it will be understood by those skilled in the art that various changes and modifications can be made therein without departing from the scope of the invention as defined in the appended claims.

What is claimed is:

1. An illuminated sign, comprising:

a housing having a first wall lying in a first plane and a peripheral wall extending around said first wall and extending from said first wall in a first direction, which is transverse to said first plane to form an illuminating recess, said housing further having a first end, a second end opposite to said first end, a first securing member located adjacent said first end;

an illuminating device located within said recess;

a first panel hingedly coupled to said second end of said housing by a hinge for pivotal movement relative to said housing between a closed position and an open position, said first panel having an inner side facing said housing and an oppositely facing outer side;

a second panel coupled directly to said outer side of said first panel, one of said first and second panels having indicia positioned thereon;

a first fastener located adjacent said first end of said housing and coupled to said first securing member and to said first panel for selectively securing said first panel in said closed position; and two second fasteners located adjacent said first end of said housing rigidly coupling said first panel and said second panel together for allowing said first and second panels to be pivoted together between said open and closed positions, said first fastener being located between said two second fasteners and said indicia being positioned between said first fastener and said second end of said housing in a second direction, which is substantially parallel to said first plane, transverse to said first direction, and towards said second end.

2. The illuminated sign according to claim 1, wherein said two second fasteners are different than said first fastener.

3. The illuminated sign according to claim 2, wherein one of said housing and said first panel has a clip and the other of said housing and said first panel has a groove for removably receiving a portion of said clip.

4. The illuminated sign according to claim 1, wherein said first fastener and said two second fasteners are threaded fasteners.

5. The illuminated sign according to claim 3, wherein said first fastener has a first head and an opposite first threaded portion, and each of said two second fasteners has a second head that is different than said first head and an opposite second threaded portion.

6. The illuminated sign according to claim 5, wherein said first fastener is a tamper-resistant screw, and said two second fasteners are drive screws.

7. The illuminated sign according to claim 1, wherein said second panel is transparent.

8. The illuminated sign according to claim 7, wherein said one of said first and second panels is said first panel and said first panel has cut outs extending completely therethrough.

9. The illuminated sign according to claim 8 further comprising:

a third panel that permits light to pass therethrough and being coupled to said inner side of said first panel.

10. An illuminated sign, comprising:

a housing having a first wall and a peripheral wall extending around said first wall to form an illuminating recess, said housing further having a first end, a second end opposite to said first end, a first securing member located adjacent said first end;

an illuminating device located within said recess;

a first panel hingedly coupled to said second end of said housing by a hinge for pivotal movement relative to said housing between a closed position and an open position, said first panel having an inner side facing said housing and an oppositely facing outer side;

a second panel coupled directly to said outer side of said first panel;

a first fastener located adjacent said first end of said housing and coupled to said first securing member and to said first panel for selectively securing said first panel in said closed position; and two second fasteners located adjacent said first end of said housing rigidly coupling said first panel and said second panel together for allowing said first and second panels to be pivoted together between said open and closed positions, and said first fastener being located between said two second fasteners, said first securing member being a bracket having an attaching element for receiving said first fastener, said attaching element being located on an attaching portion protruding from said bracket, and said attaching element being located adjacent said inner side of said first panel.

11. The illuminated sign according to claim 10, wherein said attaching element is a threaded hole.

12. The illuminated sign according to claim 11, wherein said bracket is coupled to said housing by at least one bracket fastener.

13. The illuminated sign according to claim 12, wherein said at least one bracket fastener is a threaded fastener.

14. An illuminated sign, comprising:

a housing having a first wall lying in a first plane and a peripheral wall extending around said first wall and extending from said first wall in a first direction, which is transverse to said first plane to form an illuminating recess, said housing further having a bracket with an attaching element, said bracket being positioned within said recess and being coupled to said housing by at least one bracket fastener, said peripheral wall having a first side and an opposite, second side, and said bracket being spaced from said first and second sides and being positioned substantially centrally between said first and second sides, said housing further having a first end and a second end opposite to said first end;

an illuminating device located within said recess;

a first panel hingedly coupled to said housing by a hinge for pivotal movement relative to said housing between a closed position and an open position, said first panel having an inner side facing said housing and an oppositely facing outer side;

a second panel coupled directly to said outer side of said first panel, one of said first and second panels having indicia positioned thereon;

a first fastener coupled directly to said attaching element and to said first panel for selectively securing said first panel in said closed position; and at least one second fastener rigidly coupling said first panel and said second panel together for allowing said first and second panels to be pivoted together between said closed and open positions, and said indicia being positioned between said first fastener and said second end of said housing in a second direction, which is substantially parallel to said first plane, transverse to said first direction, and towards said second end.

15. The illuminating exit sign according to claim 14, wherein said at least one second fastener is different than said first fastener.

16. An illuminating exit sign, comprising:

a housing having a first wall and a peripheral wall extending around said first wall to form an illuminating recess, said housing further having a bracket with an attaching element, said bracket being positioned within said recess and being coupled to said housing by at least one bracket fastener;

an illuminating device located within said recess;

a first panel hingedly coupled to said housing by a hinge for pivotal movement relative to said housing between a closed position and an open position, said first panel having an inner side facing said housing and an oppositely facing outer side;

a second panel coupled directly to said outer side of said first panel;

a first fastener coupled directly to said attaching element and to said first panel for selectively securing said first panel in said closed position; and at least one second fastener rigidly coupling said first panel and said second panel together for allowing said first and second panels to be pivoted together between said closed and open positions, said bracket having a protruding attaching portion located adjacent said inner side of said first panel, and said attaching element being located on said attaching portion.

17. The illuminated sign according to claim 16, wherein said attaching portion is an L-shaped portion and said attaching element is a threaded opening located on said L-shaped portion, and said threaded opening being located adjacent said inner side of said first panel.

18. The illuminated sign according to claim 17, wherein said at least one bracket fastener is a threaded fastener directly coupled to an inner surface of said first wall.

19. The illuminated sign according to claim 17, wherein said first fastener and said at least one second fastener are threaded fasteners.

20. The illuminated sign according to claim 19, wherein said at least one second fastener is a plurality of second fasteners.

21. The illuminated sign according to claim 20, wherein said first fastener is a tamper-resistant screw, and each of said plurality of second fasteners is a drive screw.

22. The illuminated sign according to claim 21, wherein said second panel is transparent.

23. The illuminated sign according to claim 22, wherein said first panel has cut outs extending completely therethrough.

24. The illuminating exit sign according to claim 23, further comprising a third panel that permits light to pass therethrough and being coupled to said inner side of said first panel.

25. The illuminated sign according to claim 24, further comprising a fourth panel being transparent and coupled directly to said first wall of said housing.

26. An illuminating sign, comprising:

a housing having a first wall and a peripheral wall extending around said first wall to form an illuminating recess, said housing further having a bracket with an attaching element, said bracket being positioned within said recess and being coupled to said housing by at least one bracket fastener;

an illuminating device located within said recess;

a first panel hingedly coupled to said housing by a hinge for pivotal movement relative to said housing between a closed position and an open position, said first panel having an inner side facing said housing and an oppositely facing outer side;

a second panel coupled directly to said outer side of said first panel;

a first fastener coupled directly to said attaching element and to said first panel for selectively securing said first panel in said closed position; and at least one second fastener rigidly coupling said first panel and said second panel together for allowing said first and second panels to be pivoted together between said closed and open positions, and said at least one bracket fastener is a threaded fastener.

27. The illuminated sign according to claim 26, wherein said at least one bracket fastener is two screws.

28. An illuminated sign, comprising:

a housing having a first wall and a peripheral wall extending around said first wall to form an illuminating recess, said housing further having a top, a bottom, and a bracket located adjacent said top with a threaded central opening;

an illuminating device positioned within said recess;

a first panel hingedly coupled to said bottom of said housing by a hinge for pivotal movement relative to said housing between a closed position and an open position, said first panel having an inner side facing said housing, an oppositely facing outer side, two top apertures, two bottom apertures, and a central aperture extending completely through said first panel, said central aperture being aligned with said central opening and between said two top apertures;

a transparent second panel coupled directly to said outer side of said first panel and having two top holes aligned with said two top apertures, and two bottom holes aligned with said two bottom apertures;

a threaded central fastener extending through said central aperture and into said threaded central opening for selectively securing said first panel to said housing in said closed position, said central fastener having a first head and an opposite first threaded portion; and four threaded perimeter fasteners for rigidly securing said second panel to said first panel, each of said perimeter fasteners extending through one of said two top holes and said two bottom holes and one of said two top apertures and said two bottom apertures, each of said perimeter fasteners having a second head and an opposite second threaded portion, said second head being different than said first head.

* * * * *